US005340616A

United States Patent [19]

Amano et al.

[11] Patent Number: 5,340,616

[45] Date of Patent: Aug. 23, 1994

[54] A COATING METHOD USING AN ELECTRIFIED WEB AND INCREASED HUMIDITY

[75] Inventors: Masayuki Amano; Makoto Kusuoka, both of Kanagawa, Japan

[73] Assignee: Fuji Photo Film., Ltd., Kanagawa, Japan

[21] Appl. No.: 743,062

[22] Filed: Aug. 9, 1991

[30] Foreign Application Priority Data

| | | | |
|---|---|---|---|
| Aug. 9, 1990 | [JP] | Japan | 2-209085 |
| Dec. 26, 1990 | [JP] | Japan | 2-413983 |
| Jan. 9, 1991 | [JP] | Japan | 3-044515 |

[51] Int. Cl.[5] ..... B05D 3/14

[52] U.S. Cl. ..... 427/458; 427/535; 427/129; 427/420; 118/DIG. 4

[58] Field of Search ..... 427/420, 13, 299, 326, 427/532, 540, 458, 535, 129; 118/621, 636, DIG. 4

[56] References Cited

U.S. PATENT DOCUMENTS

| | | | |
|---|---|---|---|
| 3,508,947 | 4/1970 | Hughes | 427/420 |
| 3,632,374 | 1/1972 | Greiller | 427/420 |
| 4,457,256 | 7/1984 | Kisler | 118/621 |
| 4,835,004 | 5/1989 | Kawanishi | 427/13 |
| 5,114,759 | 5/1992 | Finnicum et al. | 118/DIG. 4 |

FOREIGN PATENT DOCUMENTS

| | | |
|---|---|---|
| 48-32923 | 5/1973 | Japan . |
| 53-31727 | 3/1977 | Japan . |
| 55-142565 | 11/1980 | Japan . |
| 58-28740 | 2/1983 | Japan . |
| 61-146369 | 7/1986 | Japan . |
| 1104376 | 4/1989 | Japan . |
| 1258772 | 10/1989 | Japan . |

OTHER PUBLICATIONS

Kistler et al, "Finite Element Analysis of Dynamic Wetting for Curtain Coating at High Capillary Numbers", American Institute of Chemical Engineers 1982 Winter Meeting (Feb. 28–Mar. 3).

*Primary Examiner*—Terry J. Owens
*Assistant Examiner*—Katherine A. Bareford
*Attorney, Agent, or Firm*—Sughrue, Mion, Zinn, Macpeak & Seas

[57] ABSTRACT

Methods for coating various liquid coating solutions onto continuously running support webs for use in the manufacture of photographic film materials, photographic printing paper, magnetic recording materials such as magnetic recording tape, adhesive tape, information recording paper such as pressure-sensitive paper or thermal paper, and materials for use in photomechanical processes, wherein uniform coating characteristics are obtained, both at the start of coating operations and at the passage of various seams in the web. In a preferred embodiment of the invention, an electric field of a strength in a range of 100–1000 volts/cm as measured with a surface potentiometer is applied on the surface of the web to be coated and, at the same time, air having a relative humidity of 70–85% is blown against the surface of the web after the start of coating operation but just prior to a time when the thin film of coating solution impinges against the web.

3 Claims, 3 Drawing Sheets

A COATING METHOD USING AN ELECTRIFIED WEB AND INCREASED HUMIDITY

BACKGROUND OF THE INVENTION

The present invention relates to a method for coating various liquid compositions (herein referred to as coating solutions) onto continuously running support webs for use in the manufacture of photographic film materials, photographic printing paper, magnetic recording materials such as magnetic recording tape, adhesive tape, information recording paper such as pressure-sensitive paper or thermal paper, and materials for use in photomechanical processes. More particularly, the present invention relates to a curtain coating method for applying coating solutions onto webs.

There are various coating methods known in which a thin film of coating solution is allowed to impinge against a running web. Curtain coating is a typical one of such methods. In the curtain coating method, a free-falling curtain formed from one or more coating solutions is allowed to impinge against an object of interest, whereby a coating film is formed on that object. The curtain coating method has long been used in coating furniture, iron plates, etc., but, in recent years, as described in U.S. Pat. Nos. 3,508,947 and 3,632,374, attempts have been made to apply the curtain coating method to areas such as the manufacture of photographic materials where particularly high precision is required.

In the curtain coating method, it is very important that the free-falling curtain be applied uniformly at the time when the coating operation is started (herein referred to as "the application time"). Compared to a bead coating method using a slide hopper, the curtain coating method requires faster application, and the volume of the coating solution to be fed increases accordingly. This presents difficulty in achieving uniform coating at application time. If uniform application is not achievable, the coating solution will scatter to foul the surrounding area, or an undesirably thick coating will remain partly wet even after the passage through the drying zone, eventually fouling the transport rollers. Both of these phenomena lead to defective final products.

A typical example of the methods that have been proposed for achieving uniform application in the practice of curtain coating is described in U.S. Pat. No. 3,508,947. In this example, a rotatable or slidable device called a "deflector" (herein sometimes referred to as an "applicator plate") is used to form a stable curtain that insures the coating solution is supplied at a predetermined rate during the application time and to recover the coating solution prior to application.

FIG. 1 is a schematic side view, partly in section, illustrating the coating method described in U.S. Pat. No. 3,508,947. A coating solution 1 flowing over the sliding surface 5 of a slide hopper 2 falls freely in the form of thin film down the distal end of the sliding surface 5, thereby forming a curtain 6, which impinges against a running web 8 to form a coating thereon.

Prior to the start of application, a rectangular flat applicator plate 4 is extended into the falling curtain 6, as indicated by a dashed line, so that the coating solution flows down the applicator plate 4 and is then collected in a recovery tank 10. At the application time, the plate 4 pivots about a fulcrum 7 to be retracted to the position indicated by a solid line, and the coating solution is then applied onto the web 8 by permitting the curtain 6 to fall on the web. Both side edges of the curtain 6 are held by edge guides 3 that extend from the distal end of the sliding surface 5 to a point below the position where the curtain 6 impinges against the web 8.

However, the above-described method in which the curtain 6 that flows down prior to the application time is received by the applicator plate 4, which is rotatably retracted at the application time to come out of engagement with the curtain 6 suffers the disadvantage that at the moment the entire portion of the coating solution is applied across the entire width of the web 8, an undesirably thick coating forms in a certain area of the web 8. That is, at the moment the rotatably retracted applicator plate 4 comes out of engagement with the curtain 6 at the start of application, the coating solution is applied all at once across the entire width of the web 8, thereby forming an undesirably thick coating in a certain area of the web.

The cause of the formation of an undesirably thick coating may be explained as follows: When the curtain 6 impinges against the applicator plate 4 held in the position where it is extended into the curtain 6, a liquid mass H (called a "heel") collects upstream of the point of impingement, as shown in FIG. 2, and the curtain 6 is transferred from the applicator plate 4 onto the web 8 accompanied by the heel H. (Details of the heel formation were reported by S. F. Kistler and L. E. Scriven at the AIChE Winter Meeting in 1982.)

The present invention further relates to a coating method for use in the manufacture of photographic materials such as photographic films and print paper, materials for use in photomechanical processes, magnetic recording materials, pressure-sensitive copy paper, thermal copy paper, etc., in which the surface of an elongated support web that is running continuously at high speed is electrified before a coating solution such as a photographic emulsion or a suspension of magnetic particles is applied to the web.

In the manufacture of photographic materials, magnetic recording materials, recording paper, etc., coating methods are widely known in which the surface of a web running continuously at high speed is electrified before a coating solution is applied. Three typical examples of such methods are as follows:

(1) A discharge treatment is performed only at the start of coating application and/or at each time of the passage of web seams. (See Unexamined Published Japanese Patent Application No. 142565/1980).

(2) A potential of at least 0.1 kilovolt is applied to the area of the web where a bead of the coating solution is formed, or on the surface of the web immediately preceding that area. (See Unexamined Published Japanese Patent Application No. 146369/1986).

(3) Prior to application, the web is electrified to a constant charge potential under a degree of vacuum lower than a steady-state level, and, after application, the degree of vacuum is held above the steady-state level for a predetermined time before it is adjusted to the steady-state level. (See Unexamined Published Japanese Patent Application No. 258772/1989).

However, those methods have their own advantages and disadvantages. The first method is effective for the purpose of preventing the occurrence of undesirably thick coatings and streak defects at the start of application and at each time of the passage of web seams. However, it is useless for the purpose of achieving high-speed coating in a steady-state operation. If a voltage sufficient to create electric discharge were to be applied during steady-state coating operations, repellency defects tend to occur. The second method is effective for the purpose of preventing the occurrence of repellency defects during steady-state coating operations. However, if the necessary large quantity of electric charge is applied at the start of application or to nonsteady-state areas such as web seams, streaking and repellency defects are very likely to occur in steady-state areas. Conversely, if the applied electric field is small enough to avoid the occurrence of streaking and repellency defects in steady-state areas, nonsteady-state areas cannot be rendered completely stable. In the third method, in order to insure that electrification is performed at the constant charge potential reached in the steady-state operation, uniformity at the time of application and at each time of the passage of web seams is achieved by maintaining a degree of vacuum that is higher than the steady-state level.

The present invention still further relates to a coating method for use in the manufacture of photographic materials such as photographic films and print paper, materials for use in photomechanical processes, magnetic recording materials, pressure-sensitive copy paper, thermal copy paper, etc., in which a coating solution such as a photographic emulsion or a suspension of magnetic particles is applied to a continuously running elongated web, which method is particularly adapted for high-speed application.

Conventional methods for achieving high-speed application of coating solutions onto a continuously running web are classified into the following two major categories.

(1) A suction box divided into three compartments is provided in a hopper on the side where a web to be coated enters, with the three compartments aligned along the web, and a fluid, such as water, charged into the center compartment is evaporated so that the resulting vapor or air containing a large amount of water vapor is allowed to pass rapidly through the gap between the center compartment and the web (Unexamined Published Japanese Patent Application No. 32923/1973); a spray solution atomized by ultrasonic vibrations is sprayed so that it is deposited on the surface of the web on which the coating operation is to be performed (Unexamined Published Japanese Patent Application No. 31727/1987); or after preliminary treatment for rendering the web surface hydrophilic, the surface is moistened, and before it dries completely, a coating solution is applied ( Unexamined Published Japanese Patent Application No. 104376/1989).

(2) A coating solution is applied to the web after its entire surface has been electrified (U.S. Pat. No. 4,457,256).

However, the methods described above have their own defects. In the methods of the first category, the fluid evaporated in the center compartment of the suction box or the atomized fluid tends to condense around the web, or coarse liquid droplets that form directly can be deposited on the web to cause coating defects. In the second method, it is difficult in practice to form a uniform charge layer over the entire surface of the web, and the resulting unevenness in charging can potentially lead to uneven coating.

SUMMARY OF THE INVENTION

An object, therefore, of the present invention is to provide a curtain coating method that is free from the aforementioned problems of the prior art and that enables smooth application while reducing the occurrence of undesirably thick coating.

The above and other objects of the present invention can be achieved by any of the following methods:

(1) A coating method that uses a rotatable or slidable applicator plate and that performs coating by supplying a thin film of free-falling coating solution from a hopper and allowing it to impinge against a web that runs continuously around a backup roller, which method is characterized in that electric charges of either positive or negative polarity as produced by corona discharge from a high-voltage generator and an electrode are applied to the surface of the web to be coated after the start of coating operation but just prior to the time when said thin film of coating solution impinges against the web.

(2) A coating method that uses a rotatable or slidable applicator plate and that performs coating by supplying a thin film of free-falling coating solution from a hopper and allowing it to impinge against a web that runs continuously around a back roller, which method is characterized in that air having a relative humidity of 70–85% as produced from an air blower is blown against the surface of the web to be coated after the start of coating operation but just prior to the time when the thin film of coating solution impinges against the web.

(3) A coating method that uses a rotatable or slidable applicator plate and that performs coating by supplying a thin film of free-falling coating solution from a hopper and allowing it to impinge against a web that runs continuously around a backup roller, which method is characterized in that electrification at an electric field strength in a range of 100–1000 volts/cm, as measured with a surface potentiometer, is allowed to occur by corona discharge on the surface of the web to be coated, and, at the same time, air having a relative humidity of 70–85% is blown against the surface of the web to be coated after the start of the coating operation but just prior to the time when the thin film of coating solution impinges against the web.

The above and other objects of the present invention can also be attained by a coating method in which the surface of an elongated web of support running continuously at high speed is electrified before a coating solution is applied thereto in the form of a bead, which method is characterized in that the amount of electrostatic charge that is produced at the start of coating application and at each time of the passage of web seams is adjusted to be greater than that of an electrostatic charge that is produced during a steady-state coating operation.

For achieving high-speed continuous coating in the present invention, many web seams are necessary. It is therefore required from a yield viewpoint to minimize the length of undesirably thick coating and streak defects that occur downstream of each web seam.

This object of the present invention can be attained by a coating method in which a coating solution is applied to a continuously running elongated web of support, which method is characterized in that just prior to the application of the coating solution, the elongated web is electrified with a charging device, and the coating solution is applied after subsequently blowing air of 75–95% relative humidity against the surface of the support to be coated.

DESCRIPTION OF THE PREFERRED EMBODIMENTS

Figure 1:
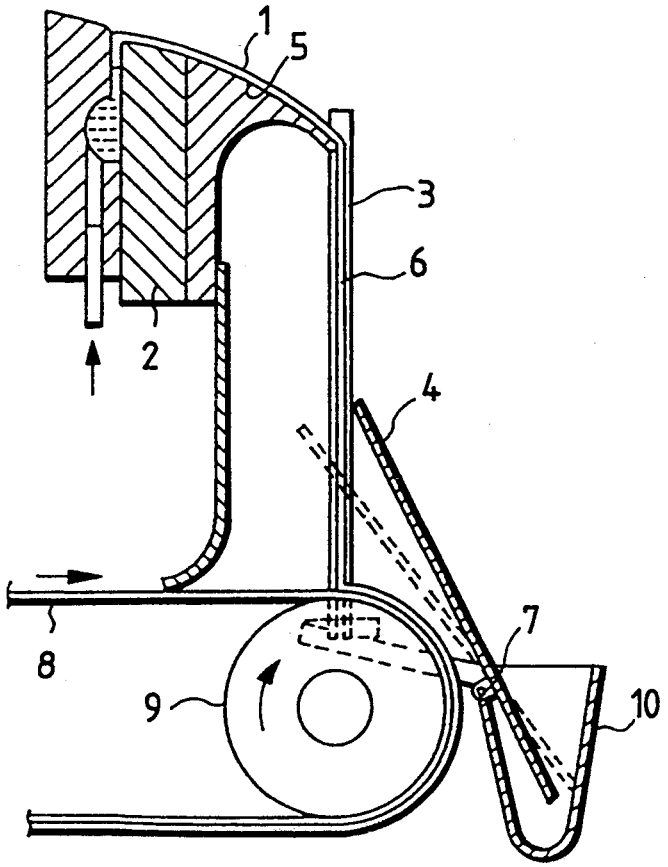
FIG. 1 PRIOR ART
FIG. 1 is a schematic side view showing, in partial cross section, a prior art coating method.
Figure 2:
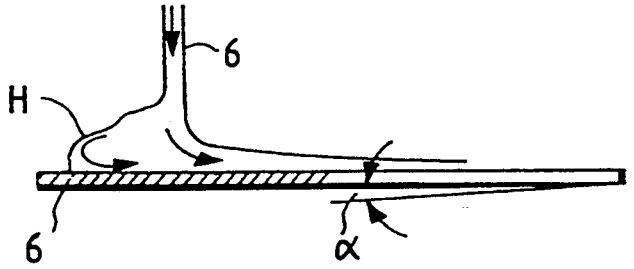
FIG. 2 PRIOR ART
FIG. 2 is a side view illustrating how a "heel" occurs at the point where a coating solution impinges against an applicator plate.

A first preferred embodiment of the present invention is described below in detail with reference to FIG. 3, which is a side view showing the embodiment schematically partly in section.

As shown, a coating solution 1 flowing over the sliding surface 5 of a slide hopper falls freely in a thin film down the distal end of the sliding surface 5, thereby forming a curtain 6. A coating is thus applied by permitting the falling curtain 6 to impinge against a web 8 that is running continuously around a backup roller 9.

Prior to application, a rectangular flat applicator plate 4 is extended out into the curtain 6, and the coating solution flows down the applicator plate 4 to collect in a recovery tank 10.

In accordance with the present invention, an electric charge of either positive or negative polarity as generated by corona discharge is applied to the surface of the web 8 to be coated just prior to the time when the curtain 6 impinges against the web 8. To this end, an electrode 13, a high-voltage generator 12 and a grounding roller 14 are installed in the path of the web 8 in a position upstream of the backup roller 9.

Further in accordance with the present invention, air having a relative humidity of 70–85% is blown against the surface of the web 8 to be coated just prior to the time when the curtain 6 impinges against the web. To this end, an air blower 11 is also installed in the path of the web 8 in a position upstream of the backup roller 9.

In order to apply the curtain 6 onto the web 8, the applicator plate 4 is retracted by rotating it about the fulcrum 7 so that the curtain 6 falls on the web 8. When the coating operation starts, corona discharge is produced from the electrode 13 and an electric charge of either positive or negative polarity is applied to the surface of the web 8 to be coated. The electric field strength of the corona discharge is preferably in the range of 100–1000 volts/cm as measured with a surface potentiometer. Below 100 volts/cm, the intended effect of the present invention is hardly obtainable; beyond 1000 volts/cm, the electrostatic attraction that develops is so strong that either the coating solution scatters about or uneven coating will occur.

Alternatively, air having a relative humidity of 70–85% as supplied from the air blower 11 can be blown against the web after the start of coating operation. Air having a relative humidity of less than 70% shows little effectiveness in achieving the object of the present invention; if air having a relative humidity higher than 85% is employed, the chance of the web of sticking to the transport roller increases.

The two application techniques described above will prove effective even if they are used individually, but to achieve better results, they are preferably used in combination. The best results can be obtained if electrification at an electric field strength of 100–1000 volts/cm, as measured by a surface potentiometer, is allowed to occur by corona discharge on the surface of the web to be coated while, at the same time, air having a relative humidity of 70–85% is blown against that surface of the web.

While the exact mechanism by which the present invention is effective against the formation of an undesirably thick coating at the time of application is not completely clear, a probable reason would be that the electrostatic attractive force acting on the web carrying the electric charge of either positive or negative polarity or the improved wetting of the web surface by the curtain as a result of the blowing of high-humidity air helps inhibit the occurrence of a "heel".

The corona discharge electrode 13 used in the present invention may be formed of a metal or carbon fibers, that it may take on various shapes such as a thin wire, a brush, a knife edge and a flat plate.

The coating solution used in the present invention may be any of various compositions depending on the specific use, as exemplified by: a coating solution of the type that is to be used in producing photographic materials which contain a light-sensitive emulsion layer, a subbing layer, a protective layer, a backing layer, etc.; a coating solution of the type that is to be used in producing magnetic recording materials which contain a magnetic layer, a subbing layer, a lubricating layer, a protective layer, a backing layer, etc.; a coating solution of the type that is to be used in producing information recording paper which contains a layer of microcapsules, a layer of a color developing agent, etc.; and a coating solution of the type that is to be used in producing photographic plate-making materials which contain a light-sensitive layer, a resin layer, a mat layer, etc.

The web to be used in the present invention may be selected from a broad range of materials including paper, plastic films, metals, resin coated paper and synthetic paper. Plastic films may be made of the various materials including polyolefins such as polyethylene and polystyrene, vinyl polymers including polyvinyl acetate, polyvinyl chloride and polystyrene, polyamides such as nylon 6,6 and nylon 6, polyesters such as polyethylene terephthalate and polyethylene-2,6-naphthalate, polycarbonates, and cellulose acetates such as cellulose triacetate and cellulose diacetate. Resins for use in resin coated paper are typified by, but not limited to, polyolefins such as polyethylene. The morphology of the surface of resin coated paper is in no way limited, and it may or may not be embossed. Metallic webs may be exemplified by an aluminum web.

The foregoing description of the present invention is directed to curtain coating using a slide hopper, but the invention may of course also be applied to an extrusion-type hopper, etc.

The following examples are provided for the purpose of further illustrating the present invention, but are in no way to be taken as limiting.

EXAMPLE 1

Figure 3:
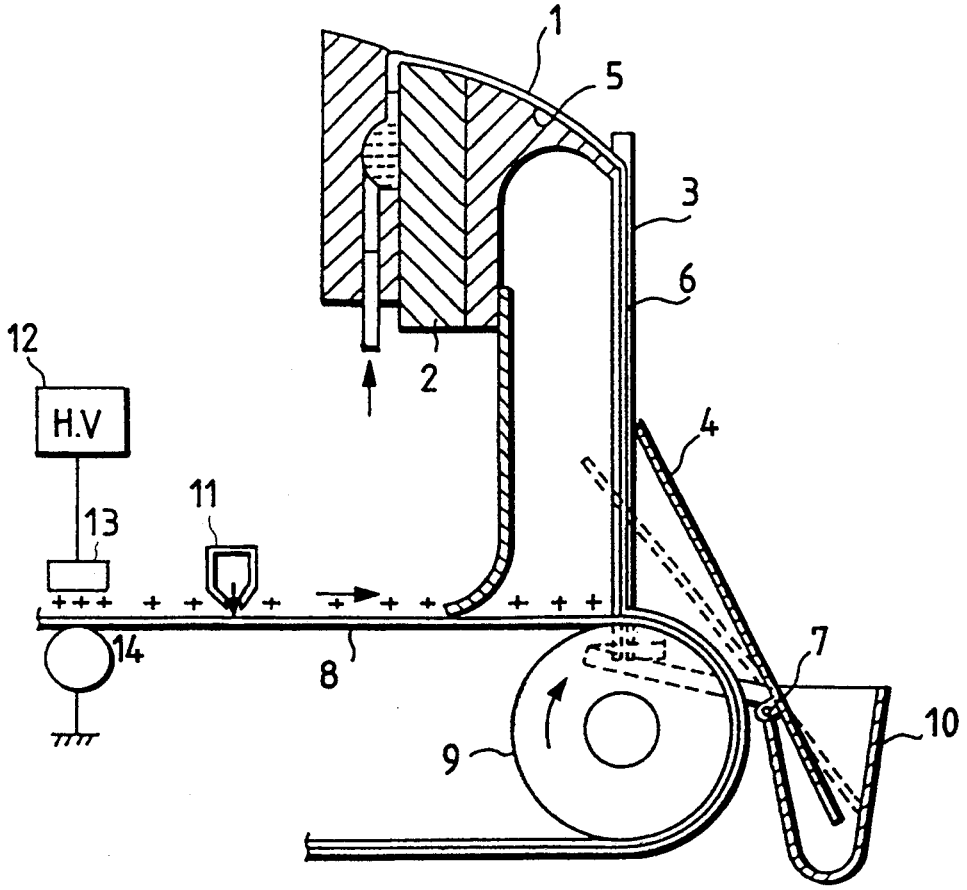
FIG. 3 is a schematic side view showing, in partial cross section, a coating method according to a first preferred embodiment of the present invention.

A coating operation was performed by the method of the present invention using an apparatus of the type shown in FIG. 3. The coating solution to be used was prepared by dissolving 70 parts by weight of a photographic alkali-processed gelatin, 1 part by weight of sodium dodecylsulfonate, and 0.6 part by weight of potassium salt of poly(vinylbenzenesulfonic acid) in 928.4 parts by weight of water. The thus-prepared coating solution had a viscosity of 40 cps at 40° C. and a surface tension of 40 dynes/cm.

The coating solution was allowed to flow down at a rate of 1.3 or 1.6 cc/sec per unit width of 1 cm, thereby forming a curtain that was applied onto a gelatin-subbed polyethylene terephthalate web that was running at a speed of 200 m/min. The falling curtain 6 was adjusted to have a height of 100 mm.

Just after the start of the coating operation, the surface of the web to be coated was electrified by corona discharge to an intensity of 300 volts/cm as measured with a surface potentiometer (Treck Co. Model 344), and, at the same time, air having a relative humidity of 70% was blown against the web surface at a velocity of 1 m/sec. At the time of application, a thick coating occurred, but the ratio of its thickness to that of the coating in a steady-state operation was within the range of 1–1.5.

EXAMPLE 2

A coating operation was performed in the same manner as in Example 1 with respect to the coating solution, support (web), coating conditions and the coating apparatus, except that no humid air was applied to the web surface. At the time of application, a thick coating occurred, but the ratio of its thickness to that of coating in a steady-state operation was within the range of 1.2–2.0.

EXAMPLE 3

A coating operation was performed in the same manner as in Example 1 with respect to the coating solution, support (web), coating conditions and the coating apparatus, except that the web surface was not electrified by a corona discharge. At the time of application, a thick coating occurred, but the ratio of its thickness to that of coating in a steady-state operation was within the range of 1.2–2.0.

COMPARATIVE EXAMPLE 1

A coating operation was performed in the same manner as in Example 1 with respect to the coating solution, support (web) and the coating conditions, except that the method described in U.S. Pat. No. 3,508,947 was implemented with a coating apparatus of the type shown in FIG. 1. At the time of application, a thick coating occurred, and the ratio of its thickness to that of the coating formed during steady-state operation was within the range of 2.0–3.0.

In the method of the present invention which performs coating by supplying a thin film of free-falling coating solution from a hopper and allowing it to impinge against a continuously running web, an electric charge of either positive or negative polarity as produced by corona discharge from a high-voltage generator and an electrode is applied to the surface of the web to be coated and/or air having a relative humidity of 70–85% as produced from an air blower is blown against the web surface just prior to the time when the thin film of coating solution impinges against the web. By so doing, the formation of a "heel", or a liquid body collecting upstream of the point of impingement on the web at the start of coating operation, is suppressed to achieve a marked reduction in the deposition of an undesirably thick coating. In this respect, the best results can be attained if the electric field strength generated by corona discharge is in the range of 100–1000 volts/cm, and if this electrification is combined with the blowing of air having a relative humidity of 70–85%.

A second embodiment of the invention will now be described with reference to FIGS. 4 and 5.

In the present invention, the amount of electric charge that is produced at the start of coating application and at each time of the passage of web seams is adjusted to be greater than that of electric charge that is produced during a steady-state coating operation. In practice, this can be accomplished by producing an electric field strength of at least 1 kilovolt/cm at the start of coating application and at each time of the passage of web seams, whereas the areas of the web under steady-state application are maintained to have an electric field strength of 0.1–0.5 kilovolts/cm. The electric field strength must be at least 1 kilovolt/cm at the start of coating application and at each time of the passage of web seams in order to insure that the relative amount of undesirably thick coating (the ratio of the amount of undesirably thick coating to that of coating in the areas of the web under steady-state application) will be no more than 130%. The upper limit of electrification at the start of coating application and at each time of the passage of web seams is preferably expressed by the voltage value beyond which spark discharge will occur. The voltage to be applied is specified to produce an electric field strength within the range of 0.1–0.5 kilovolts/cm; below 0.1 kilovolts/cm, repellency defects are likely to occur and beyond 0.5 kilovolts/cm, uneven electrification can potentially cause unevenness in the thickness of coating.

Figure 4:
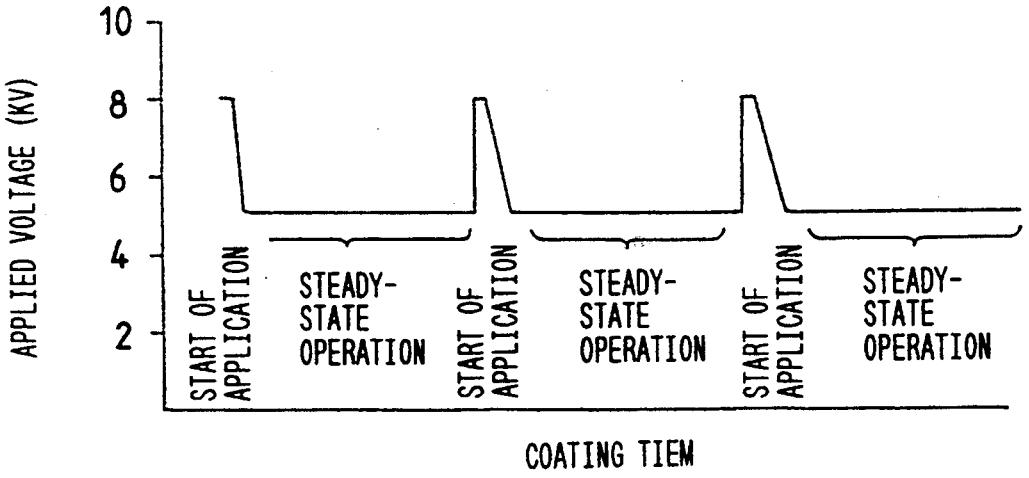
FIG. 4 is a diagram showing how voltage is to be applied over time in a continuous coating operation according to a second preferred embodiment of the present invention.
Figure 5:
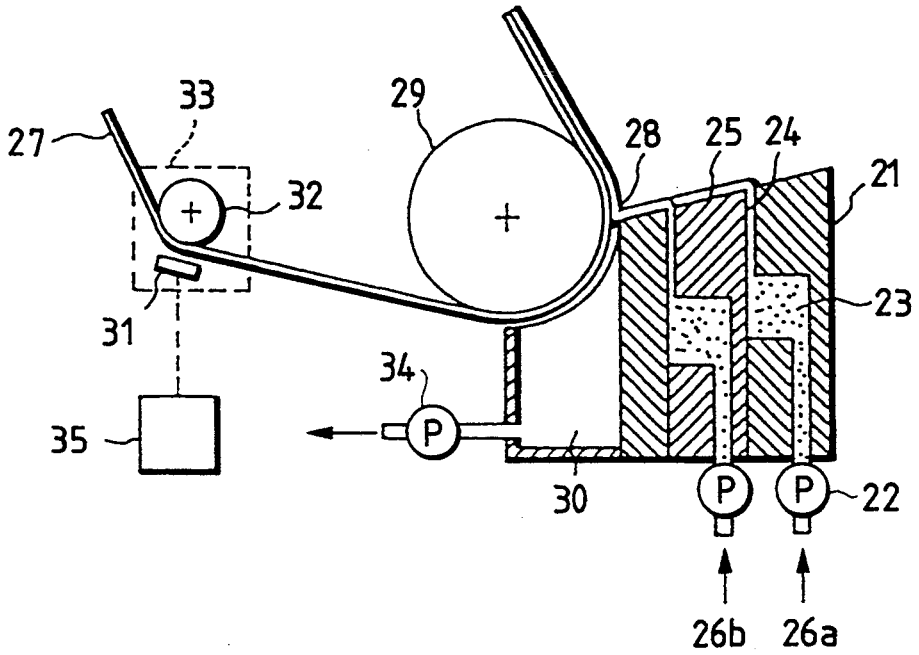
FIG. 5 is a side view of a coating apparatus that may be used to implement a second preferred embodiment of the present invention.

The profile of control in the amount of electric charge in accordance with the present invention is shown in FIG. 4, in which the horizontal axis indicates the coating time and the vertical axis the amount of electric charge in terms of applied voltage. As one can see from FIG. 4, a voltage of 8 kilovolts is applied at the start of coating operation and at each time of the passage of web seams, whereby static electric field strength builds up on the web to 1000 volts/cm. During steady-state coating operations, a voltage of 5 kilovolts is applied to cause an electric field strength of 150 volts/cm.

This embodiment of the present invention is described below in a more specific manner. The corona discharge electrode to be used in the present invention may be formed of a metal or carbon fibers, taking various shapes such as a thin wire, a brush, a knife edge and a flat plate.

The web to be used in the present invention may be any of those mentioned above with respect to the first embodiment. Also, the same coating solutions may be employed.

The coating solutions described above may be applied onto the support by various methods such as, for example, slide coating, roller bead coating, extrusion coating and curtain coating.

A specific embodiment of the present invention is described below with reference to FIG. 5. As shown therein, a coating solution 26a is supplied into a cavity 23 in a hopper 21 by means of a pump 22. In the cavity 23, the coating solution is spread to the full coating width and is fed through a slot 24 to flow down a sliding surface 25 in superposition on a coating solution 26b that flows simultaneously down the sliding surface. As a result, the two coating solutions form a bead 28 that is coated onto a support or web 27 wound onto a backing roller 29. At the start of the coating operation, and at each time of the passage of web seams, the bead 28 while contacting the web 27 tends to form a coating that is thicker than in a steady-state coating operation. To avoid this problem, a charging unit 33 is provided which is composed of a grounding roller 32 and an electrode 31 provided upstream of the area where bead coating is performed. With the web 27 being supported by the grounding roller 32, the electrode 31 beneath the web is supplied with a voltage from a high-voltage power source 35 to generate a corona discharge on the web surface so that the coating bead will adhere to it with a stronger force. A suction box 30 is also provided to create a vacuum in the precoating area of the hopper by means of a vacuum pump 34. The purpose of this suction box is to draw a certain degree of vacuum in order to enable rapid coating. In accordance with the coating method of the present invention, the voltage supplied from the high-voltage power supply is adjusted in such a way that the amount of electrostatic charge that is produced at the start of coating application and at each time of the passage of web seams is greater than that of the electrostatic charge that is produced during the steady-state coating operation.

EXAMPLE 4

An example of this embodiment of the present invention is described below for the purpose of clarifying its advantages. It should however be noted that the present invention is by no means limited to that particular example.

A coating solution (5% gelatin solution having a viscosity of 20 cps) was applied from a hopper by means of a sliding bead coater having a suction box as described above. The degree of vacuum in the suction box was held at a constant value of −50 mm ($H_2O$), whereas the coating speed was adjusted to either 150 m/min or 300 m/min. The coating operation was performed with the electric field strength being varied to three different levels. The state of the applied coating was compared for three situations: the start of coating operation, steady-state operation and the passage of each web seam. The results are shown in Table 1 below.

TABLE 1

| Electric field strength (V/cm) | Coating speed = 150 m/min | Coating speed = 300 m/min |
|---|---|---|
| Start of coating operation | | |
| 0 | relative amount of undesirably thick coating = 300% | uniform coating impossible |
| 200 | relative amount of undesirably thick coating = 140% | repellency defects occurred, relative amount of undesirably thick coating = 250% |
| 1000 | relative amount of undesirably thick coating = 110% | relative amount of undesirably thick coating = 150% |
| Steady-state operation | | |
| 0 | good | repellency defects occurred |
| 200 | good | good |
| 1000 | streak and unevenness defects occurred | streak and unevenness defects occurred |
| Passage of web seams | | |
| 0 | good | repellency defects occurred all over the surface |
| 200 | good | repellency defects occurred, relative amount of undesirably thick coating = 250% |
| 1000 | good | good |

As is clear from Table 1, the relative amount of undesirably thick coating that formed at the start of coating operations which was performed at a speed of 150 m/min could be varied by adjusting the amount of electric field strength. At a coating speed of 300 m/min, the amount of electric field strength to be generated at the start of coating operations and at each time of the passage of web seams is preferably at least 1000 volts/cm, whereas the preferred value is about 200 volts/cm during the steady-state operation. Obviously, it is desirable to adjust the amount of electric field strength depending on the specific phase of the coating operations.

According to the coating method of the above embodiment of the present invention in which the amount of electric field strength to be generated at the start of coating operations and at each time of the passage of web seams is adjusted to be greater than the amount of electrostatic charge generated during a steady-state operation, consistent production can be achieved at high yield by performing fast continuous coating operations without causing an undesirably thick coating or streak defects at the start of coating application and at each time of the passage of web seams and without causing uneven coating or streaking or repellency defects during the steady-state operation.

A third embodiment of the invention will now be described with reference to FIG. 6.

In the method of this embodiment of the present invention, the surface of the web is electrified with a charging device just prior to the application of the coating solution. To this end, a grounding roller is provided in contact with the back side of the web just upstream of the area where the coating solution is to be applied, whereas an electrode is positioned in a face-to-face relationship with, but distant from, the other side of the web, and a charging voltage in the range of 0.1–7 kV is applied, as a result of which an electric field strength will build up on the web surface up to 500 V/cm, preferably up to 300 V/cm. The number of units of the charging device is variable, and although one unit will suffice for the purpose of the present invention, two or more units are preferably used if conditions permits. This is because providing two or more units of the charging device in series so as to reduce the amount of static charge that is generated per unit is preferred for the purpose of achieving uniform electrification.

In the method of the present invention, air having a relative humidity of 75–95% is also blown against the surface of the web to be coated. Blowing air that contains water as moisture is effective in preventing vapor condensation or the formation of coarse liquid droplets. Further, contact with moist air contributes to a higher water content in the web at equilibrium, whereby a uniform distribution of static charges is achieved on the web surface.

The air to be blown against the web surface should have a relative humidity of 75–95%, preferably 80–90% Even if . air having a relative humidity of 75–95% is blown against the web, there will be little decrease in the amount of the previously generated static charge.

Figure 6:
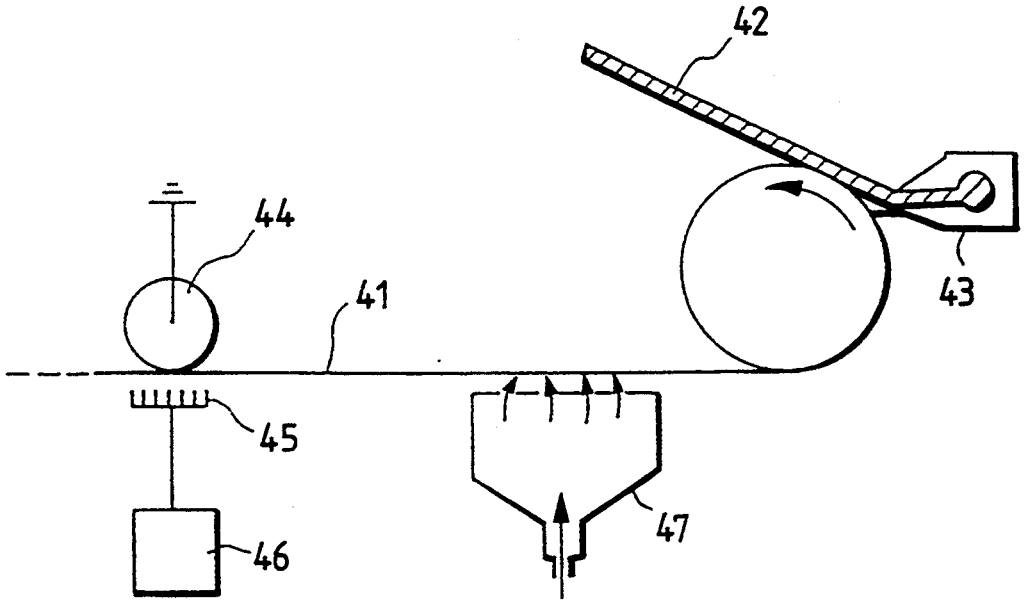
FIG. 6 is a side view showing the practice of a coating method according to a third embodiment of the present invention.

With reference now to FIG. 6, the method of the present invention consists basically of applying a coating solution 42 onto a continuously running web 41 as it is supplied from a hopper 43. In accordance with the present invention, the back side of the web 41 is supported by the grounding roll 44 just prior to the application of the coating solution, and discharge is allowed to occur under a voltage as applied to a charging electrode 45 from a high-voltage power source 46. Subsequently air having a relative humidity of 75–95% as supplied from a blower chamber 47 is blown against the web surface at a velocity of about 10 m/sec. Thereafter, the coating solution 42 as supplied from the hopper 43 is applied onto the web 41.

This embodiment of the present invention is described below in a more specific manner. The corona discharge electrode to be used in the present invention may be formed of a metal or carbon fibers, taking on various shapes such as a thin wire, a brush, a knife edge and a flat plate.

The same types of webs and coating solutions as in the first-described embodiment can be employed in the practice of this embodiment as well.

These coating solutions may be applied onto the support by various methods such as, for example, slide coating, roller bead coating, extrusion coating and curtain coating.

EXAMPLE 5

Using an extrusion coater, a coating solution (11% gelatin solution with a viscosity of 30 cps) as supplied from a hopper 43 was coated onto a polyethylene terephthalate film (100 μm thick to form a coating deposit of 50 cc/m$^2$. Just prior to the application of the coating solution, the surface of the film to be coated was electrified, and moist air was subsequently blown against it at a velocity of 10 m/sec. The specific conditions of the coating operations and the results obtained are shown in Table 2.

TABLE 2

| Run No. | Electric field strength (V/cm) | Relative humidity of moist air (%) | Maximum tolerable coating speed (m/min) | Uniformity in coating |
|---|---|---|---|---|
| Comparative Example 2 | — | — | 100 | good |
| Comparative Example 3 | — | 80 | 135 | good |
| Comparative Example 4 | 300 | — | 170 | unevenness |
| Comparative Example 5 | 500 | 80 | 200 | good |

In accordance with the present invention, coating solutions can be applied at a faster speed while eliminating the problems encountered in the practice of prior art coating techniques, namely, vapor condensation, coating defects due to coarse liquid droplets and uneven coating due to the formation of a nonuniform charge layer.

What is claimed is:

1. A coating method in which a surface of en elongated support web with web seams for connecting adjacent sections of the support web, which seams create irregularities on said surface, running continuously at a speed, is electrified before a coating solution is applied and a bead is formed, the improvement wherein:

an amount of electrostatic charge that is produced at a start of the coating application and applied to the web and during each passage of the web seams is adjusted to be greater than an electrostatic charge that is produced during a steady-state coating operation.

2. The coating method of claim 1, wherein said amount of electrostatic charge that is produced at the start of coating application and at each passage of web seams is produced with an electric field strength of at least 1 kilovolt/cm.

3. The coating method of claim 2, wherein said amount of electrostatic charge that is produced during a steady-state coating operation is produced with an electric field strength in a range of 0.1 to 0.5 kilovolts/cm.

* * * * *